United States Patent [19]

Schmitt

[11] 4,095,170

[45] June 13, 1978

[54] METERLESS IGNITION ADVANCE MEASURING DEVICE FOR INTERNAL COMBUSTION ENGINES

[75] Inventor: Herbert R. Schmitt, Lake Forest, Ill.

[73] Assignee: Snap-on Tools Corporation, Kenosha, Wis.

[21] Appl. No.: 747,642

[22] Filed: Dec. 6, 1976

[51] Int. Cl.[2] ..... F02P 17/00

[52] U.S. Cl. ..... 324/16 T; 324/17

[58] Field of Search ..... 324/16 T, 16 R, 17, 324/15; 73/116, 117.3

[56] References Cited

U.S. PATENT DOCUMENTS

| | | | |
|---|---|---|---|
| 3,512,079 | 5/1970 | Wanninger | 324/16 T |
| 3,577,077 | 5/1971 | Cross | 324/15 X |
| 3,619,767 | 11/1971 | Pelta | 324/17 |
| 3,813,931 | 6/1974 | Rennick et al. | 324/16 T X |
| 4,010,414 | 3/1977 | Reeves et al. | 324/16 T |

*Primary Examiner*—Stanley T. Krawczewicz

*Attorney, Agent, or Firm*—Vogel, Dithmar, Stotland, Stratman & Levy

[57] ABSTRACT

The ignition advance measuring device for internal combustion engines comprises a strobe lamp, a sawtooth generator and a threshold detector coupled to the generator. When the instantaneous amplitude of the sawtooth signal reaches a predetermined fixed value, the threshold detector produces a switching voltage. The switching voltage is fed back to the input of the sawtooth generator to initiate the rising portion of the sawtooth cycle. The falling portion of each cycle is initiated by the spark plug firing voltage. A knob calibrated in degrees of engine rotation is mechanically coupled to an adjustable circuit element in the sawtooth generator, which varies the duration of the falling portion of the sawtooth signal, thereby controlling delay between the occurrence of a spark and energization of the strobe lamp. The threshold level of the detector and the characteristics of the sawtooth signal itself are independent of average engine speed.

15 Claims, 5 Drawing Figures

B+
45
30
15
0
5
10
80
81

METERLESS IGNITION ADVANCE MEASURING DEVICE FOR INTERNAL COMBUSTION ENGINES

BACKGROUND OF THE INVENTION

It is common practice to provide in an automobile distributor, automatic means for advancing the firing point of each cylinder ahead of "top dead center", that is, the point at which a maximum amount of burning of fuel in the cylinder occurs. This automatic means causes the amount of advance, which is commonly measured in degrees, to vary in accordance with the engine speed. The amount of advance increases as the engine speed increases, for reasons which are well understood to those skilled in the art.

A device which measures the amount of advance at a given engine speed has a strobe lamp that is triggered by pulses corresponding to the sparks for a selected cylinder. The strobe lamp is aimed at the engine block and the adjacent rotating flywheel thereon. A timing mark on the flywheel appears stationary because the strobe cycling matches the engine speed. One such advance measuring device is disclosed in U.S. Pat. No. 2,715,711, in which operation of the strobe lamp is delayed with respect to the spark event. A knob is rotatable to adjust such delay so that the flash from the strobe lamp occurs at top dead center. The operator can then read the meter to determine the amount of advance, which is precisely equal to the delay.

It has been proposed to reduce the cost of an advance measuring device by eliminating the meter, and calibrating the knob itself so that it displays information on the amount of advance.

The knob in the advance measuring device disclosed in U.S. Pat. No. 2,715,711 cannot be so calibrated. In the circuit disclosed in this patent, rotating the knob causes the amount of resistance in a timing circuit to change. For example, if the spark event leads top dead center by 20 microseconds, then the knob would be rotated to delay the flash 20 microseconds, resulting in a given knob setting. If the speed of the engine were doubled, for example, the time between the spark event and top dead center would be halved to 10 microseconds. To achieve half the delay, the knob would be rotated to a different position, although the amount of advance in engine degrees might have been exactly the same. Thus, gradations cannot simply be added to a knob that adjusts timing alone. The circuitry must take into consideration the speed of the engine.

There have been several prior art devices which do not require a meter, but instead include a knob that is calibrated in degrees of advance. In each of these prior art devices, however, the manner in which engine speed is taken into consideration causes the device to respond slowly to rapid changes in engine speed such as occurs when an engine is running roughly. Another shortcoming of these prior devices is that several seconds are required for the measuring device to "lock in".

One such prior art device is disclosed in U.S. Pat. No. 2,785,215 to Yetter, dated Mar. 12, 1957. Taking FIG. 1 of Yetter as exemplary, a sawtooth wave is generated, applied to one terminal of a diode 24, and compared to the average amplitude of the sawtooth wave as measured by the elements 16 and 18. After a certain number of cycles have been generated, a steady state of DC voltage will be provided for the cathode of the diode 24. It takes a number of cycles to develop this average voltage, and thus several seconds are required before the advance measuring device is in condition to provide useful information. Furthermore, if the engine speed fluctuates, such as when the engine is running roughly, this average voltage does not change quickly because it is an average of a number of cycles. The elements 16 and 18 tend to smooth out these variations. The sawtooth wave on the other hand responds substantially instantly and its characteristics will take into consideration these short-term changes in engine speed. Thus, the timing mark on the flywheel of an engine which is running roughly will not appear stationary when illuminated by the Yetter device.

A second prior art device which is meterless is disclosed in U.S. Pat. No. 3,597,677 to MacCrea et al., dated Aug. 3, 1971. The advance measuring device disclosed in this patent produces a sawtooth wave which is applied to a threshold detector comprising the transistors 107 and 108, the threshold voltage level of which is determined by the setting of a potentiometer 78. This particular circuit takes into consideration variations in engine speed by examining the sawtooth present on the conductor 94. A slower engine speed will result in a tendency of the voltage at that point to increase, thereby increasing the conduction of the transistors 83 and 84, supplying a decreased bias to the transistor 66, thereby raising the effective charging impedance supplied by the transistors 66 and 67. This biasing voltage is smoothed out by virtue of the capacitors 81 and 91. It takes some time for these capacitors to charge up when the advance measuring device is turned on and it is only after such steady state is reached that accurate readings may be taken. Furthermore, if the speed tends to fluctuate such as when the engine is running roughly, these capacitors will not respond quickly but instead will smooth over such changes. So, just as with the device disclosed in Yetter, the lock-in time is relatively slow, and the measuring device does not respond to rapid fluctuations in engine speed.

The MacCrae, et al. patent requires the sawtooth amplitude to be maintained constant, which is disadvantageous since it requires close tolerances to be maintained in the parts and in the B+ supply voltage.

A third prior art device, made by Fox Valley Instrument Co., appears to be unpatented at the present but has been in the marketplace. Enclosed is a print prepared by the assignee of the present application, Snap-On Tools Corporation, based on a model of such device. In the Fox Valley unit, the threshold voltage must follow a very carefully controlled hyperbolic relationship with speed, which relationship is difficult to achieve accurately and is rather expensive. Also, the threshold voltage tends to vary with the supply voltage, thereby requiring that the supply voltage output be closely monitored. A knob, which operates a 0–5 K potentiometer, controls the slope of the rising portion of the sawtooth waveform, the greater the slope, the less the delay.

SUMMARY OF THE INVENTION

It is therefore an important object of the present invention to provide an improved meterless advance measuring device.

Another object is to provide a meterless advance measuring device which reaches its steady state condition substantially immediately when it is turned on.

Another object is to provide an improved meterless advance measuring device in which advance may be accurately measured even when there are rapid fluctuations in engine speed.

Another object is to provide a meterless advance measuring device which is extremely accurate over all engine speed ranges.

Another object of the present invention is to provide an advanced measuring device which is relatively insensitive to variations in the power supply.

In summary, there is provided a meterless advance measuring device comprising a strobe lamp and being adapted to determine the spark advance of an internal combustion engine having at least one spark plug and means for producing a sequence of firing or spark voltages for the spark plug, the combination comprising sawtooth signal generating means for generating a sawtooth signal, each cycle of which has first and second portions,, and threshold detector means coupled to the generating means and responsive to the instantaneous amplitude of the sawtooth signal exceeding a predetermined fixed threshold for producing a switching voltage, the generating means being coupled to the threshold detector means and responsive to the switching voltage to initiate the first portion of each sawtooth signal cycle, the generating means being coupled to the spark producing means and being responsive to a firing voltage to initiate the second portion of each sawtooth signal cycle, the strobe lamp being responsive to the switching voltage and energized upon the production thereof, the generating means including means for varying the duration of the second portion of each sawtooth signal cycle to select the amount of delay between the occurrence of a firing voltage and the energization of the strobe lamp.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the invention.

BRIEF DESCRIPTION OF THE DRAWINGS

For the purpose of facilitating an understanding of the invention, there is illustrated in the accompanying drawings, a preferred embodiment thereof, from an inspection of which, when considered in connection with the following description, the invention,, its construction, and operation, and many of its advantages should be readily understood and appreciated.

BRIEF DESCRIPTION OF THE DRAWINGS

Figures 1, 1A:
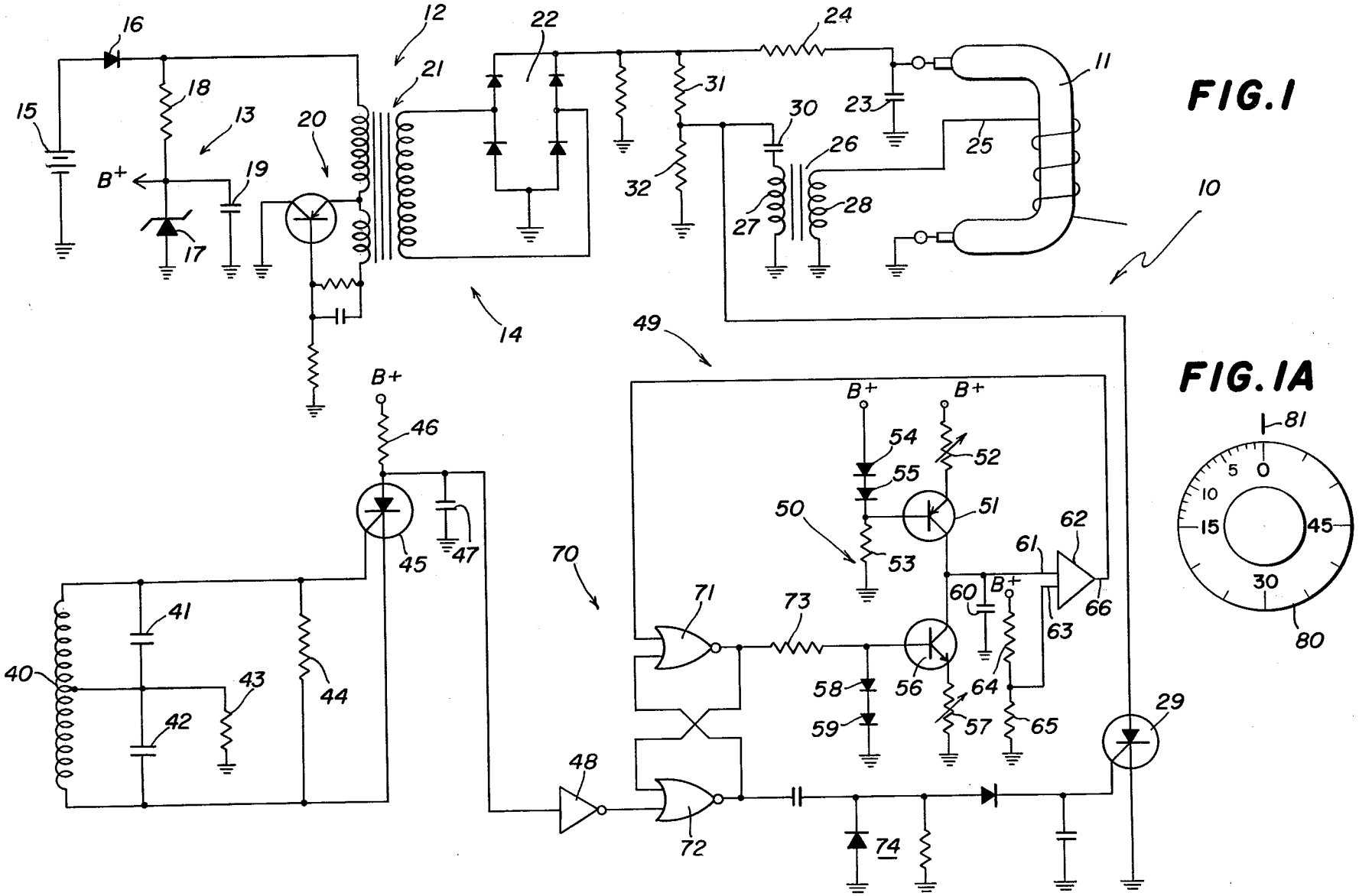
Figure 2A:
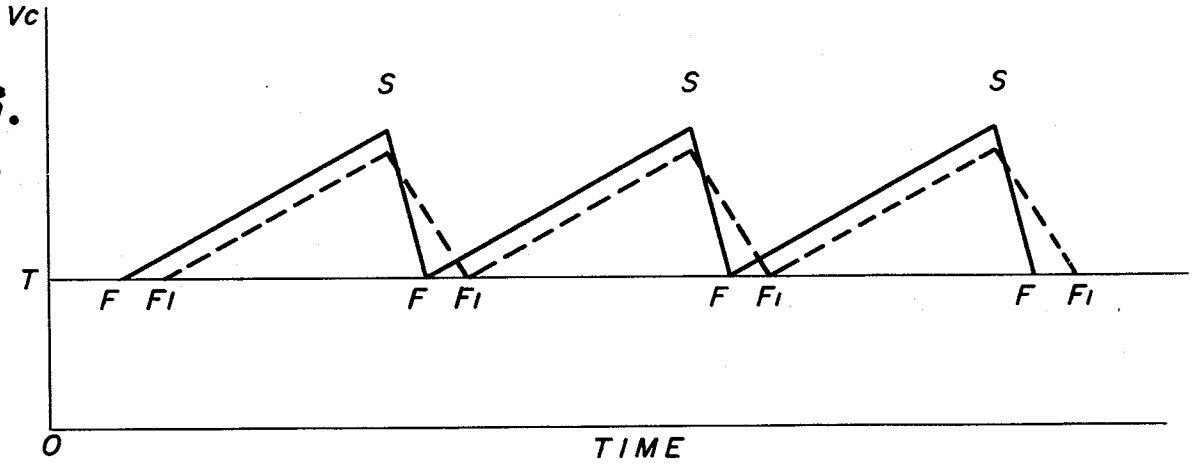
Figure 2B:
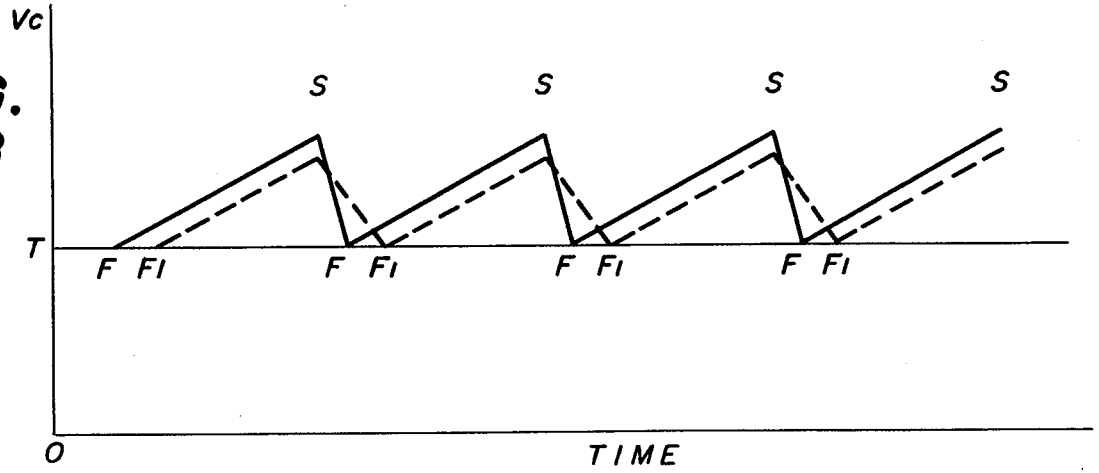

FIG. 1 is a schematic drawing of a meterless advance measuring device incorporating the features of the present invention;

FIG. 1A depicts a knob which is mechanically connected to a potentiometer in the circuit of FIG. 1 to vary the amount of time between the spark event and the flash of the strobe lamp;

FIG. 2A is a graph of the sawtooth voltage produced in the circuit of FIG. 1 for different settings of the potentiometer;

FIG. 2B is a graph like FIG. 2A but at a different engine speed; and

Figure 3:
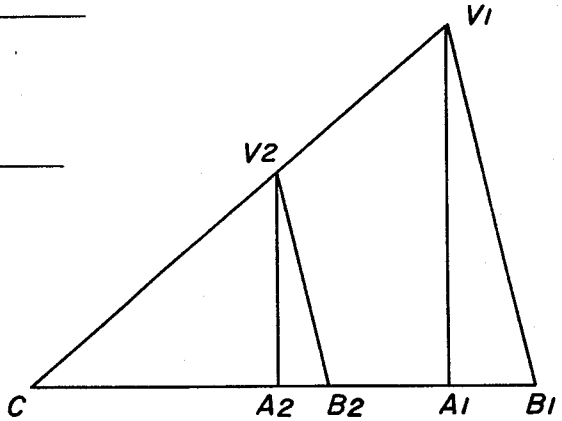

FIG. 3 is a geometrical representation of the principles of operation of the circuit of FIG. 1.

DESCRIPTION OF THE PREFERRED EMBODIMENT

Referring to the drawing, there is depicted in FIG. 1 a meterless advance measuring device incorporating the features of the present invention, and being represented by the numeral 10. All of the elements depicted in the device 10 are mounted in a housing (not shown) which normally has a gun shape. The advance measuring device 10 includes a flash tube 11 that is periodically energized at a rate corresponding to the speed of the engine which is being evaluated.

The advance measuring device 10 also includes a power supply 12 having one portion 13 to produce a relatively low value DC voltage and a second portion 14 to produce a DC voltage of much higher value to energize the flash tube 11. The entire power supply 12 is powered by a battery 15. A diode 16 protects the components in the portion 13 against damage which could result from the inadvertent reversal of the terminals of the battery 15. The portion 13 includes a Zener diode 17, a resistor 18 and a capacitor 19, which together provide a relatively low DC voltage labeled B+.

The other portion 14 of the power supply 12 includes an oscillator 20, the oscillatory signal from which is stepped up by a transformer 21 and rectified by a full wave bridge 22. The high DC voltage produced thereby charges a capacitor 23 through a current limiting resistor 24. During the periods when the flash tube 11 is nonconductive, the capacitor 23 is charged up. When the tube 11 is rendered conductive by the application of a voltage to the trigger electrode 25, the capacitor 23 is rapidly discharged through the flash tube 11 to produce a high intensity flash of very short duration.

The voltage for the trigger electrode 25 is produced by a trigger transformer 26 having a low voltage primary winding 27 and a high voltage secondary winding 28. One terminal of the secondary winding is connected to ground and the other terminal is connected to the trigger electrode 25. Energization of the primary winding 27 is controlled by a silicon controlled rectifier (SCR) 29. The primary winding 27 is connected to a capacitor 30. A DC source for charging the capacitor 30 is furnished by a voltage divider including the resistors 31 and 32. The SCR has its anode connected to the capacitor 30 and has its cathode connected to ground. When the SCR 29 is nonconductive, current flows through the capacitor 30 and the primary winding 27 until the capacitor 30 is fully charged. When the SCR 29 is rendered conductive in the manner to be described hereinafter, the capacitor 30 is discharged rapidly through the SCR 29 and the primary winding 27, causing a rapid change in the current through such winding, thereby generating a high voltage in the secondary winding 28, which voltage is applied to the trigger electrode 25 of the flash tube 11 to fire the same. The firing of the SCR 29 is caused by the application of a positive voltage to its control electrode.

Detection of a spark event is obtained by a center tapped inductor 40 which is shaped to clamp onto the wire that connects a spark plug to its associated terminal on the distributor. By induction, pulses of opposite polarity appear at opposite ends of the inductor 40. Capacitors 41 and 42 are coupled across the inductor 40 and a resistor 43 of small value effectively grounds the center tap of the inductor 40. The capacitors 41 and 42 are selected to tune the inductor 40. A resistor 44 is coupled across the inductor 40 and constitutes a load therefor. The inductor 40 is coupled respectively to the control and cathode electrodes of an SCR 45, the anode of which is coupled through a load resistor 46 to the B+ supply voltage. It will be remembered that this B+ supply voltage was furnished by the power supply 12. A capacitor 47 prevents low noise pulses from falsely triggering the SCR 45. The negative spike from the SCR 45 produced in response to the spark event, is inverted by an inverter 48 to provide a positive pulse.

The circuit 49 for operating the SCR 29 a selected time after the occurrence of the positive pulse from the inverter 48 as a result of the spark event, will now be described. The circuit 49 includes a sawtooth generator 50 having a PNP transistor 51, the emitter of which is coupled through a potentiometer 52 to the B+ supply voltage. The base of the transistor 51 is connected to a biasing circuit including a resistor 53 connected to ground and a pair of diodes 54 and 55 connected to the B+ supply voltage. This biasing circuit establishes a predetermined bias on the base of the transistor 51. The transistor 51 and its associated biasing circuit constitute a constant current supply as will be described.

The sawtooth generator 50 further includes an NPN transistor 56 having its emitter connected through a potentiometer 57 to ground reference potential. The collector of the transistor 56 is connected to the collector of transistor 51. A pair of diodes 58 and 59 are connected in series between the base of the transistor 56 and ground. These diodes limit the voltage on the base of the transistor 56 to approximately 1.4 volts. The transistor 56 and its associated components constitutes a constant current sink as will be described. The collector-emitter path of the transistor 56 is in series with the collector-emitter path of the transistor 51.

The sawtooth generator 50 also includes a capacitor 60 connected between the juncture of the collectors of the transistors 51 and 56 and ground reference potential.

The output of the sawtooth generator 50 is coupled to the signal input 61 of a threshold detector 62. A second input 63 has a fixed threshold voltage applied thereto by way of a voltage divider including the resistors 64 and 65 connected between the B+ supply voltage and ground reference potential. When the instantaneous value of the sawtooth on the input 61 exceeds the fixed DC voltage on the input 63, the threshold detector 62 produces a switching voltage on the output 66.

The circuit 49 further includes a control means 70 having a pair of NOR gates 71 and 72 connected in the manner shown to define a bistable multivibrator circuit. One output from the control means 70 is coupled by way of a resistor 73 to the base of the transistor 56. A second output from the control means 70 appears on the output of the NOR gate 72 and is coupled through a wave shaping circuit 74 to the control electrode of the SCR 29.

In operation it will be assumed that a cycle starts with the occurrence of a flash by the flash tube 11. Immediately thereafter, the output of the NOR gate 71 is low so that the transistor 56 is nonconductive. The transistor 51 is always conductive and current flows therethrough to charge the capacitor 60. The biasing of the transistor 51 is such that it furnishes a constant current source so that the charge of the capacitor 60 is substantially linear. When the spark event occurs, causing the output of the inverter 48 to become high, the output of the NOR gate 71 also becomes high, causing the transistor 56 to conduct, to permit the capacitor 60 to discharge through the collector-emitter path thereof and the potentiometer 57. The biasing of the transistor 56 is such that it provides a constant current sink for the capacitor 60, whereby the discharge thereof is substantially linear. The capacitor 60 discharges until the voltage thereacross falls to the threshold voltage on the input 63. It will be remembered that this threshold voltage is determined by the voltage divider consisting of the resistors 64 and 65. Upon reaching such threshold value, the detector 62 provides a switching voltage on the output 66 which is fed back to the NOR gate 71 causing its output to again become low, thereby turning off the current sink defined by the transistor 56. At the same time, the output of the NOR gate 72 becomes high once again. The transition from low to high at the output of the NOR gate 72 is reflected as a positive pulse applied to the SCR 29. As explained previously, such positive pulse triggers the flash tube 11. The same instant the flash tube 11 flashes, a new cycle commences by virtue of the capacitor 60 now beginning to charge again.

The rate of discharge of the capacitor 60 is determined by the value of the potentiometer 57. The discharge will be linear, but the higher the resistance as supplied thereby, the slower the rate of discharge and therefore the longer the delay from the spark event to the time where the capacitor 60 has discharged to the threshold value to cause the flash tube 11 to flash.

Mechanically coupled to the potentiometer 57 is a knob 80, such as shown in FIG. 1A, which is calibrated in degrees of ignition advance. When the knob is in a position corresponding to "0", the resistance furnished by the potentiometer 57 is substantially 0, whereby the capacitor 60 discharges substantially instantaneously and the flash tube 11 would flash at substantially the same time as the spark event. The greater the resistance furnished by the potentiometer 57, the longer the delay. The amount of delay in degrees of ignition advance is read directly from the knob.

When the operator aims the gun within which the advance measuring device 10 is mounted at the engine block, the flash tube 11 flashes at a rate corresponding to the speed of the engine because it is being triggered by the spark events therefrom. Thus the timing marks on the flywheel will appear to be stationary. By rotating the knob 80 to change the value of the potentiometer 57, a selected timing mark on the flywheel may be made to align with a fixed timing mark on the engine block. The operator then can determine the amount of advance by noting the gradation on knob 80 opposite the adjacent indexing mark 81.

Further details of the operation of the advance measuring device 10 may be obtained by reference to the graphs of FIGS. 2A and 2B. In FIG. 2A, the engine is rotating at a given speed corresponding to the period between spark events "S". The solid line represents a setting of the knob 80 for a relatively short delay between the spark event S and the flash F of the tube 11. If the engine has a greater advance, that would be manifest by the position of the knob 80. As shown by the dashed line in FIG. 2A, the slope of the falling portion decreases accordingly. The initiation of such falling portion still commences with the spark event S but because of the greater resistance the rate of discharge is slower causing the tube 11 to flash to $F_1$. When the sawtooth voltage reaches the threshold level T, the detector 62 produces a switching voltage which as explained previously causes the tube 11 to flash, at $F_1$, and causes the sawtooth waveform to begin rising again, as shown. The peak-to-peak amplitude of the sawtooth waveform with greater delay, is less than the corresponding amplitude with less delay.

In FIG. 2B, the engine speed has been increased as can be seen by the shorter period between the spark events S. The solid line represents the same delay as the solid line waveform of FIG. 2A, while the dashed line in FIG. 2B corresponds to the same delay as that resulting from the dashed line in FIG. 2A. The slope of the rising portion is always the same irrespective of speed or delay. The slope of the falling portion is the same for a given delay, that is, the solid lines SF are parallel in FIGS. 2A and 2B, and the dashed lines $SF_1$ are parallel in both figures. The solid lines SF being parallel, for example, means that the position of the knob 80 representing the amount of resistance furnished by the potentiometer 57 is the same, corresponding to the same delay, despite the difference in engine speed.

It will be noted that the circuit 49 does not produce a voltage dependent on the average amplitude of a number of cycles in the sawtooth waveform. The circuit 49 is therefore "locked in" within the first few cycles. If the engine speed fluctuates rapidly such as when the engine is running roughly, the sawtooth waveforms may be for example considered to vary between the conditions shown in FIGS. 2A and 2B. However, at any instant the delay is represented by the slope of the line SF, or $SF_1$, and is accurately represented on the knob 80, again because there is no averaging of several cycles of the sawtooth.

FIG. 3 depicts a triangle which illustrates the basic principles of the invention. In similar triangles, the length of the line segment formed by the intersection of the line drawn perpendicular to a side and also through the opposite vertex and another vertex will vary in direct proportion to the length of the side opposite the former vertex. Triangles $CV_2B_2$ and $CV_1B_1$ are similar, and line segments $A_2B_2$ and $A_1B_1$ are in direct proportion to line segments $CB_2$ and $CB_1$. Therefore, the ratios $A_2B_2/CB_2$ and $A_1B_1CB_1$ are identical. If on a time scale, point C is the time of the flash of the tube 11, point $A_2$ is the next spark event, and point $B_2$ is the time of the next flash of the tube 11, then regardless of the time between flashes, the ratio of the time between the spark event and the next flash to the time between flashes (or spark events) will be constant.

The time between flashes (or spark events) represents 720 engine degrees in a four cycle automobile engine, regardless of speed. Therefore, for any similar triangle, the time between the spark event and the flash of the flash tube 11 will represent the same number of engine degrees as determined by the slope of VB. If VB has a very steep slope, then AB will represent a lesser amount of engine degrees between spark and flash. If VB has a very shallow slope, then AB will represent more engine degrees between the spark event and flash. Therefore, by controlling the slope of VB, control is exercised over the delay in engine degrees between the spark event and the flash event, and for any given slope, the number of degrees is the same for all speeds.

To calibrate the device 10, the knob 80 is set so that the 60° mark (0° mark after complete revolution) is aligned with the adjacent indexing mark 81. The device 10 is then aimed at an engine known to have an advance of 60°. The potentiometer 52 is adjusted to align the timing mark on the flywheel with the fixed mark on the engine block. There is currently no known specification on an automobile engine requiring an advance of more than 45°. Thus a range of 0° to 60° is ample.

In order to achieve a 0° to 60° range, the ratio of the slope of the rising portion of each cycle of the sawtooth wave to the slope of the falling portion, should be at least 11 to 1. At a setting of 60°, the rise time would be 11 times the fall time (660° vs. 60°). As the setting is reduced, the ratio increases. Theoretically at 0°, the fall time is instantaneous and the ratio is infinity.

In theory, the current source defined by the transistor 51 is turned on only when the transistor 56 is disabled and vice versa. In the circuit 49, only the current sink is turned on and off to minimize the number of parts required. This is feasible when the transistor 56 draws many times more current than the current through the transistor 51. The current through the transistor 56 varies with the setting of the potentiometer 57, but in one embodiment, that current was at least 11 times the current through the transistor 51. This figure, of course, corresponds to the 11:1 ratio of the slopes discussed above.

It is noteworthy that the exact level of the threshold at the input 63 is not important as long as its value is stable.

When the measuring device 10 is turned on, it will take a period of time within which to reach its steady state condition or, in other words, "lock in". That time is dependent upon the setting of the potentiometer 57 and the engine speed. The time is longest when the potentiometer 57 is set to provide the greatest delay, that is 60°, and the engine speed is slowest. Under such conditions, an embodiment of the invention locked in less than one second. As the resistance furnished by the potentiometer 57 is decreased and/or the engine speed is increased, the lock-in time decreases.

In an operating example of the embodiment depicted in FIG. 1, the parts had the following values:

| Part | Value |
|---|---|
| Potentiometer 52 | 0 to 10 K |
| Resistor 53 | 27 K |
| Potentiometer 57 | 0 to 5 K |
| Capacitor 60 | .68 microfarads |
| Resistor 64 | 4.7 K |
| Resistor 65 | 1 K |
| Resistor 73 | 12 K |
| B+ Supply Voltage | 8.2 volts |

Such device is capable of measurements of advance within the range of 0° to 60° at ±1° over a range of engine speed between 450 rpm and 8,000 rpm.

What has been described therefore is a meterless advance measuring device which locks in rapidly and provides accurate advance readings despite rapid fluctuations in engine speed. Furthermore, the readings are accurate over all engine speed ranges despite fluctuations in the B+ voltage.

I claim:

1. In an advance measuring device having a strobe lamp and being adapted to determine the spark advance of an internal combustion engine having at least one spark plug and means for producing a sequence of spark voltages for the spark plug, the combination comprising: sawtooth signal generating means for generating a sawtooth signal each cycle of which has first and second portions, and threshold detector means coupled to said generating means and responsive to the instantaneous amplitude of said sawtooth signal exceeding a predetermined fixed threshold for producing a switching voltage, said generating means being coupled to said threshold detector means and being responsive to the switching voltage to initiate the first portion of each sawtooth signal cycle, said generating means being coupled to the spark producing means and being responsive to a spark voltage to initiate the second portion of each sawtooth signal cycle, the strobe lamp being responsive to the switching voltage and energized upon the production thereof, said generating means including means for varying the duration of the second portion of each sawtooth signal cycle to select the amount of delay between the occurrence of a spark voltage and the energization of the strobe lamp.

2. The combination set forth in claim 1, wherein said duration varying means is constructed and arranged to adjust the slope of the second portion of each sawtooth signal cycle.

3. The combination set forth in claim 1, and further comprising a dial calibrated in degrees of engine rotation and being mechanically coupled to said duration varying means.

4. The combination set forth in claim 1, and further comprising control means having a first input coupled to said threshold detector means, a second input coupled to the spark producing means, and an output coupled to said sawtooth signal generating means, said control means being responsive to the occurrence of the switching voltage to produce a control voltage that persists until occurrence of the next firing voltage to cause said generating means to generate the first portion of each sawtooth signal cycle, said control means being responsive to the occurrence of a firing voltage to cause the absence of the control voltage until the occurrence of the next switching voltage to cause said generating means to generate the second portion of each sawtooth signal cycle.

5. The combination set forth in claim 4, wherein said control means is a bistable multivibrator.

6. The combination set forth in claim 4, wherein said control means has a second output and is responsive to the switching voltage to produce a further control voltage for operating the strobe lamp.

7. A meterless advance measuring device to determine the spark advance of an internal combustion engine having at least one spark plug and means for producing a sequence of spark voltages for the spark plug, said device comprising: sawtooth signal generating means for generating a sawtooth signal each cycle of which has first and second portions, threshold detector means coupled to said generating means and responsive to the instantaneous amplitude of said sawtooth signal exceeding a predetermined fixed threshold for producing a switching voltage, said generating means being coupled to said threshold detector means and being responsive to the switching voltage to initiate the first portion of each sawtooth signal cycle, said generating means being coupled to the spark producing means and being responsive to a spark voltage to initiate the second portion of each sawtooth signal cycle, and a strobe lamp responsive to the switching voltage and energized up the production thereof, said generating means including means for varying the duration of the second portion of each sawtooth signal cycle to select the amount of delay between the occurrence of a spark voltage and the energization of said strobe lamp.

8. In an advance measuring device having a strobe lamp and being adapted to determine the spark advance of an internal combustion engine having at least one spark plug and means for producing a sequence of spark voltages for the spark plug, the combination comprising capacitance means, a substantially constant current source coupled to said capacitance means for substantially linearly changing the voltage thereacross in one direction, a substantially constant current sink coupled to said capacitance means for substantially linearly changing the voltage thereacross in the opposite direction, said current sink having adjustable means therein for adjusting the rate at which the voltage across said capacitance means changes in the opposite direction, threshold detector means coupled to said capacitance means and responsive to the instantaneous voltage across said capacitance means exceeding a predetermined fixed threshold level for producing a switching voltage, and control means for selectively placing said current sink in an operative condition in which current is taken from said capacitance means and an inoperative condition in which substantially no current is taken from said capacitance means, said control means being coupled to said threshold detector means and being responsive to said switching voltage to place said current sink in its operative condition, said control means being coupled to the spark producing means and being responsive to a spark voltage to place said current sink in its inoperative condition, the strobe lamp being responsive to the switching voltage and energized upon the production thereof.

9. The combination set forth in claim 8, wherein said current source includes calibrating means.

10. The combination set forth in claim 8, wherein said substantially constant current source defines a charging resistance for said capacitance means, said charging resistance means being independent of frequency of the spark voltages.

11. The combination set forth in claim 8, wherein said substantially constant current source is continously connected to said capacitance means, and the current drawn by said current sink is many times the current furnished by said current source.

12. The combination set forth in claim 8, wherein said substantially constant current source includes a first transistor with a collector-emitter path, and fixed biasing means for said first transistor, said substantially constant current sink including a second transistor with a collector-emitter path, said collector-emitter paths being connected in series and said capacitance means being coupled to the juncture of said paths, said control means selectively furnishing biasing for said second transistor.

13. The combination set forth in claim 8, wherein the current drawn by said current sink varies in accordance with the setting of said adjustable means and is at least 11 times the current furnished by said current source.

14. The combination set forth in claim 8, wherein said adjustable means is a potentiometer.

15. The combination set forth in claim 8, and further comprising a dial calibrated in degrees of engine rotation and being mechanically coupled to said adjustable means.

* * * * *